US010811828B1

(12) United States Patent
Zhou et al.

(10) Patent No.: US 10,811,828 B1
(45) Date of Patent: Oct. 20, 2020

(54) USB CABLE

(71) Applicants: Wei-Feng Zhou, Kowloon (HK); Chun-Wai Chan, Kowloon (HK)

(72) Inventors: Wei-Feng Zhou, Kowloon (HK); Chun-Wai Chan, Kowloon (HK)

( * ) Notice: Subject to any disclaimer, the term of this patent is extended or adjusted under 35 U.S.C. 154(b) by 0 days.

(21) Appl. No.: 16/699,164

(22) Filed: Nov. 29, 2019

(51) Int. Cl.

| | |
|---|---|
| ***H01R 13/60*** | (2006.01) |
| ***H01R 13/72*** | (2006.01) |
| ***H01R 13/502*** | (2006.01) |
| ***H01R 25/00*** | (2006.01) |
| *H01R 13/52* | (2006.01) |

(52) U.S. Cl.
CPC ..... *H01R 13/72* (2013.01); *H01R 13/5025* (2013.01); *H01R 25/003* (2013.01); *H01R 13/5213* (2013.01)

(58) Field of Classification Search
CPC .... H01R 13/518; H01R 23/025; H01R 35/04; H01R 25/006
USPC ..... 439/534, 536, 6, 8, 535
See application file for complete search history.

(56) References Cited

U.S. PATENT DOCUMENTS

| | | | | |
|---|---|---|---|---|
| 5,542,151 | A * | 8/1996 | Stranski | A47D 13/063 16/326 |
| 5,983,541 | A * | 11/1999 | Shih | G09F 19/02 40/410 |
| 6,165,010 | A * | 12/2000 | Prazoff | H01R 25/168 362/421 |
| 6,522,530 | B2 * | 2/2003 | Bang | G06F 1/16 16/367 |
| 7,644,472 | B2 * | 1/2010 | Chang | E05D 11/1078 16/330 |
| 2008/0104800 | A1 * | 5/2008 | Chang | E05D 11/1078 16/250 |

* cited by examiner

*Primary Examiner* — Phuong Chi Thi Nguyen

(57) ABSTRACT

A USB cable contains: a holder, a body, and a conductive assembly. The holder includes a protective shell, a connection disc, and a decoration cap. The protective shell has a first accommodation chamber, a fixing sheet, and a protection cap. The body includes a receiving seat, a male plug, a locking member, a fixer, a PCB, a resilient piece, and a covering member. The receiving seat has a second accommodation chamber. The conductive assembly includes a first lid, a second lid, a defining sheet, a PCB plug, and a retractable wire. The retractable wire is connected with the PCB of the body, the PCB plug is accommodated in the cross-cross groove of the covering member, the body is received in the first accommodation chamber of the protective shell of the holder, and the receiving seat is connected with the decoration cap.

6 Claims, 4 Drawing Sheets

USB CABLE

FIELD OF THE INVENTION

The present invention relates to a USB cable which and is mounted on a backpack, a school bag, or a briefcase and contains a connection disc.

BACKGROUND OF THE INVENTION

A conventional mobile power device and a conventional USB cable are applied to charge electricity to a notebook computer, a tablet, and a smart phone.

The smart phone is electrically connected with an end of the USB cable, and the other end of the USB cable is electrically connected with the mobile power device. However, when the mobile power device is put in a backpack, a school bag, or a briefcase, the USB cable is winded easily. In addition, the backpack has to be opened before extending the USB cable out of the backpack.

The present invention has arisen to mitigate and/or obviate the afore-described disadvantages.

SUMMARY OF THE INVENTION

One aspect of the present invention is to provide a USB cable which and is mounted on a backpack, a school bag, or a briefcase, wherein the USB device and the USB cable are pulled in a single direction so that the mobile power device and the smart phone are connected with the USB cable and the USB device without opening the backpack.

To obtain the above aspects, a USB cable provided by the present invention contains: a holder, a body, and a conductive assembly.

The holder includes a protective shell, a connection disc, and a decoration cap. The protective shell has a first accommodation chamber, a fixing sheet arranged on a bottom of the protective shell, and a protection cap connected on a peripheral wall of the protective shell. The connection disc is located behind the fixing sheet of the holder, and the decoration cap is received in the first accommodation chamber of the protective shell.

The body includes a receiving seat, a male plug, a locking member, a fixer, a PCB, a resilient piece, and a covering member. The receiving seat has a second accommodation chamber, and the fixer has two extension parts. The resilient piece is elongated, and the covering member has a cross-cross groove. The male plug, the locking member, the fixer, the PCB, and the resilient piece are accommodated in the second accommodation chamber of the receiving seat. The covering member is connected with the receiving seat.

The conductive assembly includes a first lid, a second lid, a defining sheet, a PCB plug, and a retractable wire. The defining sheet is configured to connect the PCB plug with an end of the retractable wire, and the first lid and the second lid is covered on the PCB plug and the defining sheet.

The retractable wire is connected with the PCB of the body, and the PCB plug is accommodated in the cross-cross groove of the covering member. The body is received in the first accommodation chamber of the protective shell of the holder, and the receiving seat is connected with the decoration cap.

Preferably, the protective shell, the decoration cap, the receiving seat, the fixer, the PCB, and the covering member are circular.

Preferably, the protective shell is made of silicone.

Preferably, the connection disc is a peripheral wall of any one of a backpack, a school bag, and a briefcase.

Preferably, the PCB plug is a three-way PCB plug.

Preferably, the retractable wire has a length.

DETAILED DESCRIPTION OF THE PREFERRED EMBODIMENTS

Figure 1:
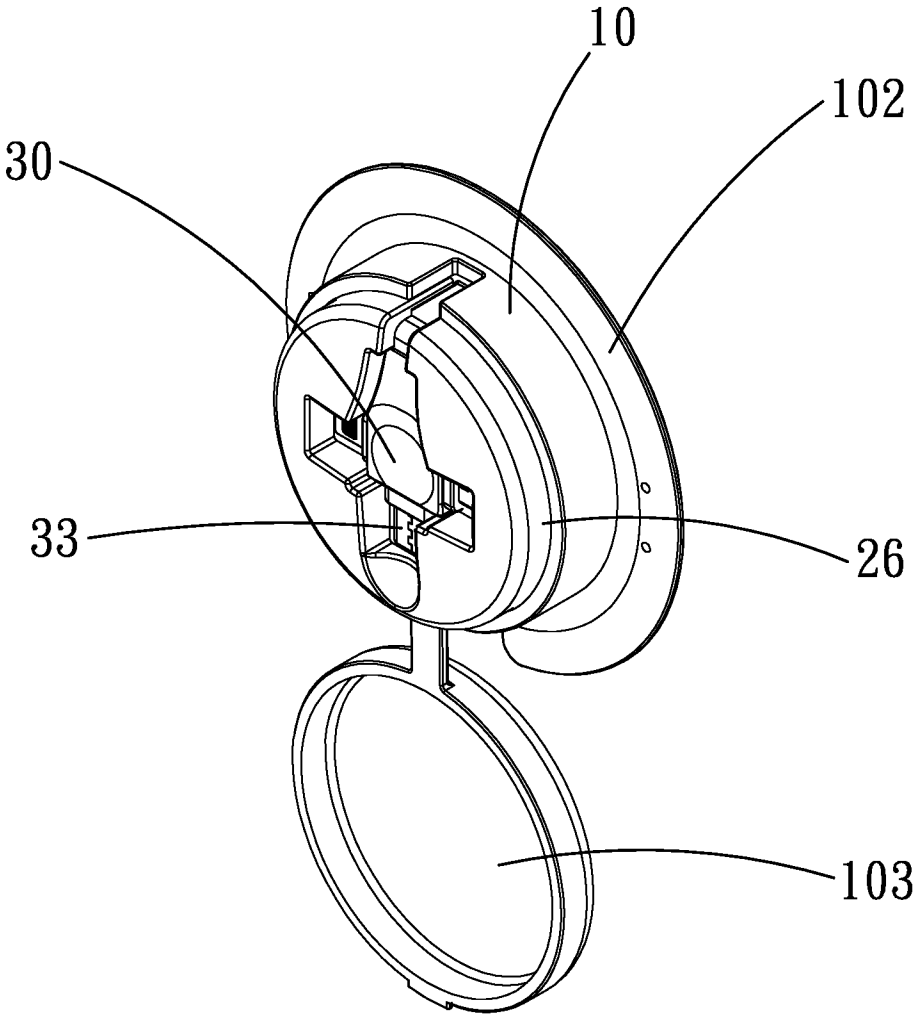
FIG. 1 is a perspective view showing the assembly of a USB cable according to a preferred embodiment of the present invention.
Figure 2:
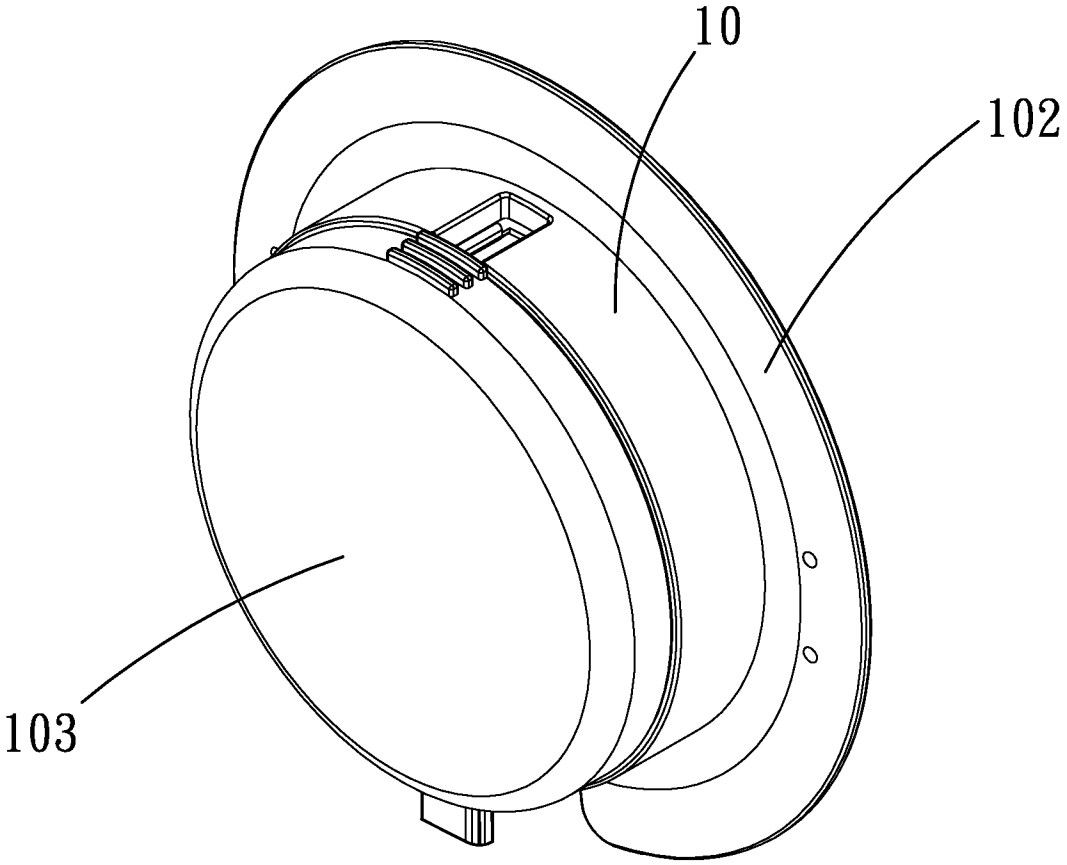
FIG. 2 is a perspective view showing the assembly of the USB cable according to the preferred embodiment of the present invention.
Figure 3:
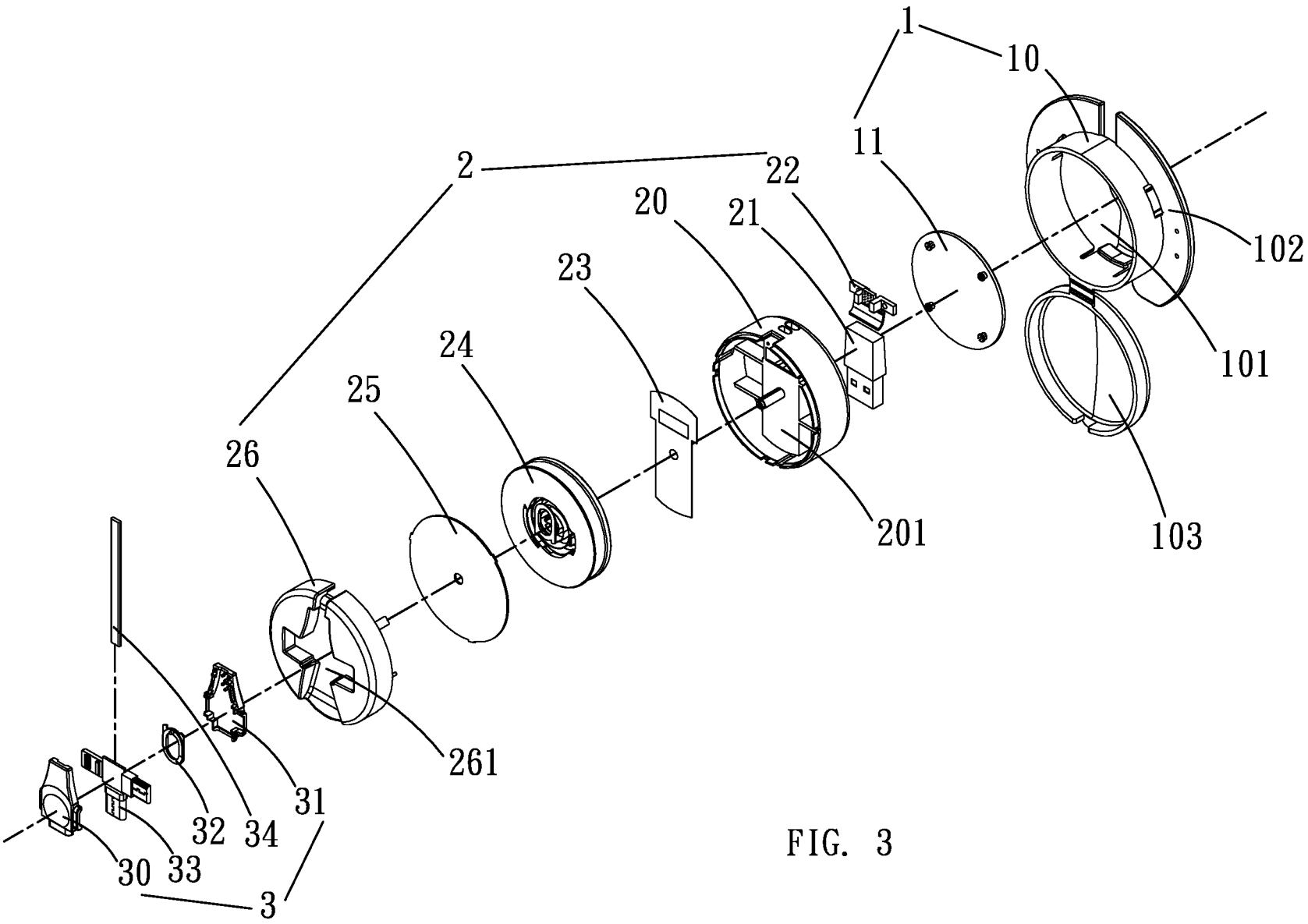
FIG. 3 is a perspective view showing the exploded components of the USB cable according to the preferred embodiment of the present invention.
Figure 4:
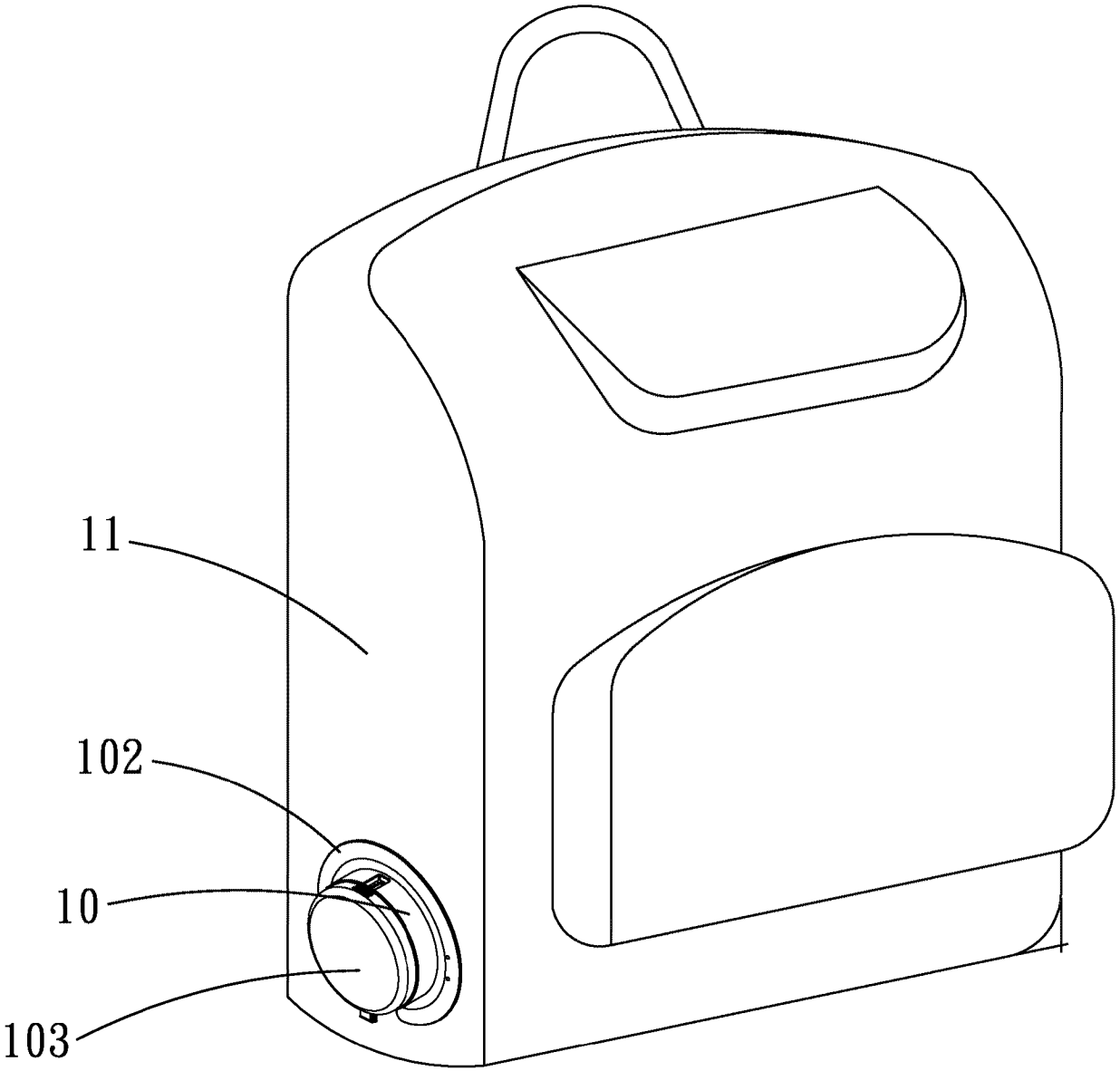
FIG. 4 is a perspective view showing the application of the USB cable according to the first embodiment of the present invention.

With reference to FIGS. 1 to 4, a USB cable according to a preferred embodiment of the present invention comprises: a holder 1, a body 2, and a conductive assembly 3.

The holder 1 includes a protective shell 10, a connection disc 11, and a decoration cap 12. The protective shell 10 has a first accommodation chamber 101, a fixing sheet 102 arranged on a bottom of the protective shell 10, and a protection cap 103 connected on a peripheral wall of the protective shell 10. The connection disc 11 is located behind the fixing sheet 102 of the holder 1. The decoration cap 12 is received in the first accommodation chamber 101 of the protective shell 10.

The body 2 includes a receiving seat 20, a male plug 21, a locking member 22, a fixer 23, a printed circuit board (PCB) 24, a resilient piece 25, and a covering member 26. The receiving seat 20 has a second accommodation chamber 201. The fixer 23 has two extension parts. The resilient piece 25 is elongated. The covering member 26 has a cross-cross groove 261, wherein the male plug 21, the locking member 22, the fixer 23, the PCB 24, and the resilient piece 25 are accommodated in the second accommodation chamber 201 of the receiving seat 20, and the covering member 26 is connected with the receiving seat 20.

The conductive assembly 3 includes a first lid 30, a second lid 31, a defining sheet 32, a PCB plug 33, and a retractable wire 34. The defining sheet 32 is configured to connect the PCB plug 33 with an end of the retractable wire 34, and the first lid 30 and the second lid 31 are covered on the PCB plug and the defining sheet 32, wherein the retractable wire 34 is connected with the PCB 24 of the body 2, the PCB plug 33 is accommodated in the cross-cross groove 261 of the covering member 26, the body 2 is received in the first accommodation chamber 101 of the protective shell 10 of the holder 1, and the receiving seat 20 is connected with the decoration cap 12.

The protective shell 10, the decoration cap 12, the receiving seat 20, the fixer 23, the PCB 24, and the covering member 26 are circular. The protective shell 10 is made of silicone, and the connection disc 11 is a peripheral wall of any one of a backpack, a school bag, and a briefcase. The PCB plug 33 is a three-way PCB plug, and the retractable wire 34 has a length.

The protective shell 10 is configured to fix the USB cable on the backpack and to protect the body 2.

The decoration cap 12 is configured to connect the receiving seat 20 with the holder 1 and to obtain aesthetic appearance.

The receiving seat 20 is configured to fix the fixer 23 and to obtain the aesthetic appearance.

The male plug 21 is electrically connected with a mobile power device.

The locking member 22 is configured to fix a USB charging cable.

The fixer 23 is configured to fix and protect the resilient piece 25.

The PCB 24 is configured to transmit electric current and to stabilize voltage.

The resilient piece 25 is configured to control the length of the retractable wire 34 so as to expend or retract the retractable wire 34.

The covering member 26 is configured to protect the USB cable.

The first lid 30 is configured to protect the PCB plug 33.

The second lid 31 is configured to protect the PCB plug 33.

The defining sheet 32 is configured to fix and protect the PCB plug 33 and the retractable wire 34.

The PCB plug 33 is configured to connect a smart phone.

The retractable wire 34 is configured to transmit the electric current and to adjust the length of the PCB plug 33.

The length of the retractable wire 34 is adjustable by using the resilient disc 25.

The holder 1 is positioned on the backpack by ways of the connection disc 11, the mobile power device is accommodated in the backpack, the decoration cap 12 is opened, and the USB male plug 21 of the body 2 is connected with the mobile power device. The protection cap 103 of the protective shell 10 is opened, and the PCB plug 33 is connected with the smart phone. In the meantime, the length of the retractable wire 34 is adjustable so as to expand or retract the PCB plug 33. After retracting the retractable wire, and the protection cap 103 is covered on the protective shell 10, thus charging power easily and protecting the PCB plug 33.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A USB cable comprising:

a holder including a protective shell, a connection disc, and a decoration cap, wherein the protective shell has a first accommodation chamber, a fixing sheet arranged on a bottom of the protective shell, and a protection cap connected on a peripheral wall of the protective shell; the connection disc is located behind the fixing sheet of the holder; the decoration cap is received in the first accommodation chamber of the protective shell;

a body including a receiving seat, a male plug, a locking member, a fixer, a PCB, a resilient piece, and a covering member; wherein the receiving seat has a second accommodation chamber; the fixer has two extension parts; the resilient piece is elongated; the covering member has a cross-cross groove, wherein the male plug, the locking member, the fixer, the PCB, and the resilient piece are accommodated in the second accommodation chamber of the receiving seat, wherein the covering member is connected with the receiving seat;

a conductive assembly including a first lid, a second lid, a defining sheet, a PCB plug, and a retractable wire; the defining sheet configured to connect the PCB plug with an end of the retractable wire, and the first lid and the second lid being covered on the PCB plug and the defining sheet;

wherein the retractable wire is connected with the PCB of the body, the PCB plug is accommodated in the cross-cross groove of the covering member, the body is received in the first accommodation chamber of the protective shell of the holder, and the receiving seat is connected with the decoration cap.

2. The USB cable as claimed in claim 1, wherein the protective shell, the decoration cap, the receiving seat, the fixer, the PCB, and the covering member are circular.

3. The USB cable as claimed in claim 1, wherein the protective shell is made of silicone.

4. The USB cable as claimed in claim 1, wherein the connection disc is a peripheral wall of any one of a backpack, a school bag, and a briefcase.

5. The USB cable as claimed in claim 1, wherein the PCB plug is a three-way PCB plug.

6. The USB cable as claimed in claim 1, wherein the retractable wire has a length.

* * * * *